United States Patent [19]

Harper

[11] Patent Number: 4,515,999

[45] Date of Patent: May 7, 1985

[54] FULL TRAVEL KEYBOARD

[75] Inventor: William P. Harper, Danielson, Conn.

[73] Assignee: Rogers Corporation, Rogers, Conn.

[21] Appl. No.: 460,370

[22] Filed: Jan. 24, 1983

[51] Int. Cl.[3] ..... H01H 13/70

[52] U.S. Cl. ..... 200/5 A; 200/159 B; 200/340

[58] Field of Search ..... 200/5 A, 159 B, 340, 200/86 R

[56] References Cited

U.S. PATENT DOCUMENTS

| | | | |
|---|---|---|---|
| 3,699,294 | 10/1972 | Sudduth | 200/86 R X |
| 3,780,237 | 12/1973 | Seeger, Jr. et al. | 200/5 A |
| 3,829,632 | 8/1974 | Klehm | 200/5 A |
| 3,862,382 | 1/1975 | Glaister et al. | 200/5 A |
| 3,879,586 | 4/1975 | Du Rocher et al. | 200/5 A |
| 3,969,600 | 7/1976 | Sims, Jr. | 200/5 A X |
| 4,129,758 | 12/1978 | Gilano et al. | 200/5 A |
| 4,251,697 | 2/1981 | Rico Gonzalez | 200/5 A |
| 4,439,646 | 3/1984 | Bouvrande | 200/5 A |

*Primary Examiner*—J. R. Scott

*Attorney, Agent, or Firm*—Fishman & Dionne

[57] ABSTRACT

A full travel membrane keyboard is presented having membrane switches with an elastomeric layer between the membrane switching array and upper mechanical elements of the key, the elastomeric layer serving to evenly distribute actuation forces, contribute to the sensation of pretravel and provide the sensation of overtravel. The assembly results in reduced cost and reduced number of components.

17 Claims, 3 Drawing Figures

FULL TRAVEL KEYBOARD

BACKGROUND OF THE INVENTION

This invention relates to the field of full travel keyboards. More particularly, this invention relates to key configurations for full travel keyboards of the high speed data entry type.

High speed data entry type keyboards are typically used in conjunction with computers or word processors. The requirements for keyboards of this type are such that not only must the keyboard close a unique circuit or generate a unique electrical signal for each key, but the keyboard must do so in a way that is comfortable for the keyboard operator to use. An operator may enter data via a keyboard of this type continuously for long periods of time, often for stretches of several hours at a time. It is, therefore, extremely important and a significant part of the value of a keyboard of this type that it be operable comfortably and reliably for a sustained period of time. The variables involved in the issues of comfort and reliability of such keyboards in use are generally referred to in the art as the "human factors" variables. These human factor variables typically consist of: (a) the total amount of key travel (i.e., from the beginning of the stroke to the end of the stroke of the key); (b) the amount of pretravel (i.e., the travel of the key prior to closure of the switch); (c) the location of the actuation or "fire" point (i.e., the point at which the switch is actuated to generate the electrical signal); (d) the amount of overtravel of the key (i.e., the travel of the key after the switch has been closed; and (e) discontinuity of the force versus displacement curve in the operation of the keyboard (i.e., whether or not the actuation cycle provides tactile feedback to the operator). Springs of various types and arranged in various cooperating arrays are conventionally used to provide the preferred set of human factors values.

One of the more commonly known prior art switch types of the full travel category is the capacitance type. In capacitance type switches, a thin aluminum foil disk connected to the key stem is mechanically introduced into an electrical field between two electrical conductors, which serve as the plates of a capacitor. The introduction of the conductive disk into the electric field between the conductors instantaneously reduces the dielectric constant of the space between the conductors. The conductor pairs are arranged in a matrix, the location of each of which is unique. Thus, by the technique of change in dielectric constant upon actuation of key, a signal unique to each key may be generated, sensed and electronically converted to a standard digital code. Keys of this type are reliable and have long life. However, they are relatively expensive and are characterized by having a large number of mechanical parts.

Membrane switches are another technology whose use has been considered or even found application in full travel high speed data entry keyboards. A membrane switch is a very thin, essentially planar, element. Typically, a membrane switch consists of sheets of insulating plastic with conductor patterns formed thereon by one or more conventional printed circuit techniques. In a high speed data entry type keyboard, individual mechanical keys are associated with specific switch locations of the membrane elements. An important problem in the design of such keyboards is to provide the desired human factors values for pretravel, overtravel, controlled actuation point and the appropriate force versus deflection values. These considerations require special attention when it is desired to incorporate membrane switch technology (in the form of a monolithic array of unique mechanical switches arranged in a matrix) in a high speed data entry keyboard, because the use of the membrane switch configuration presents special problems with regard to these human factors values. Prior to the present invention, the approach to this problem has typically resulted in a key switch configuration which incorporates multiple springs and large numbers of plastic parts, with resultant expense. That presents a certain irony and anachronism, in that one of the original objectives of membrane switch technology was to eliminate the large number of parts and mechanical complexity and expense of key switch elements.

SUMMARY OF THE INVENTION

The above discussed and other problems of the prior art are overcome or substantially reduced by the key switch and keyboard configuration of the present invention. The keyboard of the present invention has a membrane switch assembly which includes a bottom stiffener layer, a passive membrane switch circuit layer on the stiffener, an insulating spacer or separator on the passive membrane layer, and an active membrane layer switch circuit on the other side of the spacer. Both the passive and active membrane layers have electrical conductors thereon (formed by printed circuit techniques) arranged in a geometrical pattern and cooperating with holes in the separator layer to define an array of unique switch and circuit locations. The application of an appropriate force to a switch site on the upper surface of the active layer causes the active layer and its particular switch component to make mechanical and electrical contact through the appropriate hole in the spacer with the circuit pattern on the fixed or passive layer of the membrane.

A layer of elastomeric material is positioned on and attached to the upper surface of the active layer of the membrane switch array. The elastomeric material must have a compressibility factor such that a force exerted on the elastomeric material in the direction downward into and perpendicular to the plane of the sheet will have a predicitable force versus displacement characteristic in a range compatible with tolerances suitable to the particular end use to which the keyboard is being applied. The keyboard assembly is completed by an array of mechanical key elements associated with and for the purpose of actuating each of the individual key locations in the membrane array. The key elements deliver actuating force to the key locations or key sites of the membrane keyboard, and the key elements include apparatus for precise displacement of a key cap prior to the making of electrical contact in the membrane array to provide the operator of the switch and keyboard with the sensation of pretravel. The key elements also include a geometically defined configuration for compressing the elastomeric material on the upper portion of the membrane array both before and after closing the membrane switch, so that compression of the elastomeric material both contributes to the sense of pretravel and generates the overtravel perceived by the keyboard operator.

Keyboards made in accordance with the present invention have switching life and reliability equivalent to those found in capacitive type arrays, while at the same time having significantly reduced cost for the assembled keyboard and requiring fewer plastic parts and springs than in prior art assemblies of this type. Also, these advantages of the present invention are accomplished in a configuration in which the human factors variables requirements are met.

A key switch element in accordance with the present invention may be viewed as being a cooperative arrangement of three spring systems. These three spring systems are comprised of (1) a mechanical spring (between the key cap and a key stem in each key), (2) the elastomer layer on the membrane array, and (3) each membrane key switch site. The mechanical spring between the key cap and key stem provide for most of the pretravel sensation. The elastomeric layer on the membrane switch array acts as a spring element both to contribute to pretravel and to distribute the closure force from the key stem uniformly over the entire area of the membrane switch (i.e., the area defined at each opening in the spacer or separator layer). The elastomeric layer also decellerates and stops the key travel uniformly by cushioning the impact of the key stem actuator. The elastomeric layer also contributes the sensation of overtravel, and it can also provide for quite, "klack" free operation when the actuator/elastomer interface is properly defined. The membrane key switch itself contributes a spring characteristic in that it moves from the separated and open circuit configuration to a mechanically and electrically closed state in response to the application and imposition of a specifically defined actuating force, thus accomplishing control of the actuating or "fire" point.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike or with prime (') superscript in the several FIGURES.

DESCRIPTION OF THE PREFERRED EMBODIMENT

Figure 1:
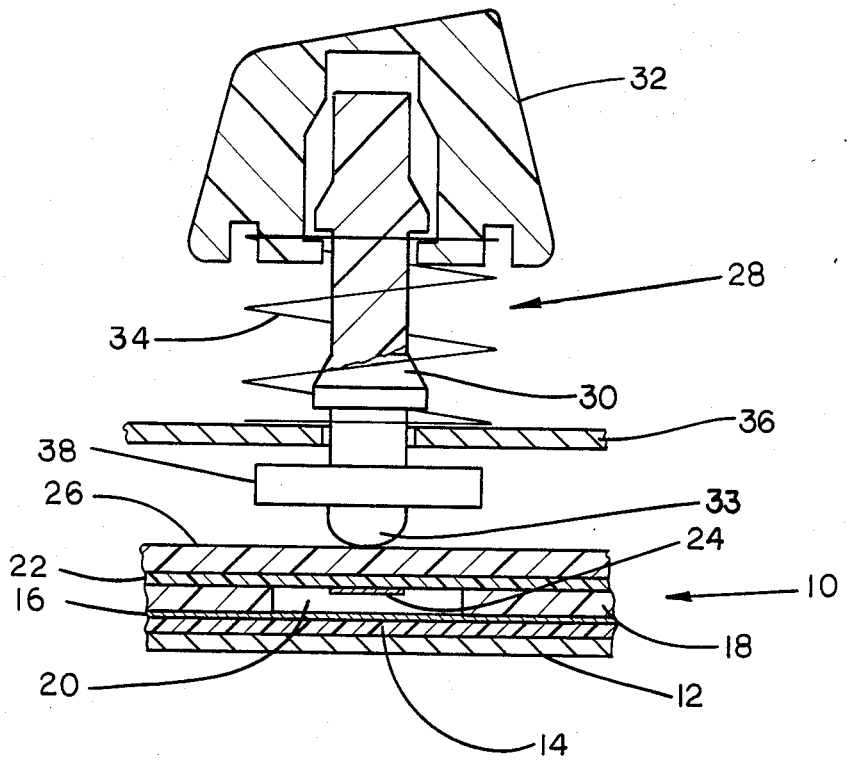
FIG. 1 is a cross-sectional elevation view showing a portion of a keyboard in accordance with the present invention and one key assembly.

Referring first to FIG. 1, a portion of the keyboard in accordance with the present invention is shown. In FIG. 1, one key location is shown, but it will be understood that an entire keyboard is made up of a monolithic membrane circuit structure and a plurality of individual mechanical keys.

A portion of a monolithic membrane keyboard or circuit array 10 is shown in FIG. 1. The monolithic membrane keyboard or switch structure includes a bottom stiffener or rigidizing layer 12 which may be a plastic or metal sheet with stiffness and flatness equivalent to aluminum 6061 alloy and approximately 0.020 inches thick. Stiffener 12 serves to support and maintain in planar condition a fixed or passive layer of the key switch assembly which consists of an insulating layer 14, preferably of Mylar polyethylene film, and a circuit pattern 16 formed thereon. This fixed or passive key switch layer is adhesively bonded to stiffener 12. Insulating layer 14 may be of any desired thickness, preferably between 0.002 inches to 0.007 inches, and the conductive pattern thereon may be formed by any known printed circuit technique, such as by printing a conductive ink, printing or etching a conductive metal foil, etc. Preferably, the conductive pattern 14 should be reasonably thin (on the order of 0.005 inches in thickness, and preferably about 0.001 inches thick). An insulating spacer or separator layer 18 having a plurality of openings 20 is bonded to the side of the passive layer on which the circuit pattern 16 is located. Spacer 18 is also preferably a plastic film such as Mylar, or equivalent. Each of the holes 20 in spacer 18 defines a key location or switch location at which mechanical and electrical contact can be made to close a key actuated switch. Spacer 18 may be adhesively bonded to or otherwise fixed relative to the lower circuit layer. The size of the openings 20 in spacer 18 and the total thickness of spacer 18 are important to the mechanical function of the switch, in that the thickness of the spacer determines the distance which has to be travelled by another switching component, and the size of the hole is an important factor in determining the actuating force required to close the switch. Hole size diameters of from about 0.0250 inches to 1.00 inches and film thickness of from 0.003 inches to 0.020 inches may be employed, with a hole diameter of from 0.375 inches to 0.750 inches being preferred and a film thickness of 0.003 inches to 0.010 inches being preferred.

A movable or active switch layer is positioned on top of the spacer 18. The movable or active switch layer comprises an insulating layer 22, e.g., Mylar, and a conductive pattern 24. The insulating layer 22 is bonded or otherwise fixed relative to the spacer layer 18, and the conductive pattern 24 is positioned so that it faces lower conductive pattern 16 at the location of hole 20 and directly above the conductive pattern on the fixed lower layer. When a force of sufficient magnitude is centered on or distributed uniformly about the portion of the upper insulating layer 22 at the location of hole 20, the upper circuit layer is moved downwardly through the hole 20 to effect mechanical and electrical contact between the conductive patterns 24 and 16 to close a switch and deliver an electrical signal.

An elastomeric layer 26 is located on and may be bonded to the upper surface of upper insulating layer 22. The elastomeric layer is comprised of a material whose thickness and compressibility are such that when the elastomeric layer is subjected to a downward force generally centered above the separator hole 20, that force is transmitted to and distributed in the upper circuit layer in such a way as to close the switch and absorb further force caused by the downward movement of the force exerting element without damage to the membrane key switch assembly. The properties of the elastomer layer 26 should also be such that compression and closure of the switch can occur from 20 million to 100 million times with predictable mechanical response in properties. For the purposes of this invention, compressibility is defined in terms of the penetration in centimeters of a $\frac{1}{8}$ inch diameter rod with a round end of 1/16 inch radius into a sheet of elastomer as the result of a downward force (in NT) normal to the plane of the sheet. As defined herein, "compressibility", is equivalent to a spring constant ($1/K=F/X$) where F is the force exerted as described and X is the distance travelled by the compressing member. Elastomers with compressibilities of between 0.10 cm/nt to 1.00 cm/nt (about 0.011 in/oz (av.) to about 0.110 in/oz (av.)) are usable in the present invention with compressibility in a range of from 0.250 cm/nt to 0.50 cm/nt (about 0.028 in/oz (av.) to about 0.056 in/oz (av.)) being preferred. In a preferred embodiment of the present invention, the elastomer material was a 0.020 inch thick layer of mechanically frothed polyurethane foam material available from Rogers Corporation under either the trademark "PORTRON" or "PORON" having a compressibility of about 0.375 cm/nt (0.042 in/oz). Elastomeric layer 26 is adhesively bonded to or otherwise fixed relative to the upper circuit layer.

As previously indicated, it will be understood that the membrane switch assembly and elastomeric layer which have been described are in the form of a monolithic assembly of the several sheets of material, with a plurality of the openings 20 in the separator layer 18 defining a plurality of key or switch sites.

An actuator or key 28 is associated with each key or switch site. The key includes a stem 30 with a geometrically formed switch actuator 33 at the end thereof in contact with elastomeric layer 26. Key 28 also has a key cap 32 and a spring 34 positioned between the cap 32 and a top or retainer plate 36 to normally space the key cap 32 from the top of stem 30. The entire key assembly (other than spring 34) is preferably made of molded plastic elements.

Actuator 33 is of rigid material and is shaped so that it applies a force to and compresses the elastomeric layer 26 without shredding, tearing or otherwise damaging the elastomeric layer. For this purpose, with a radius of 1/32 of an inch to $\frac{1}{8}$ of an inch being preferred; and the end of actuator 32 in contact with the elastomeric layer is rounded, preferably hemispherical, within a range and radius from 0.03 inches to 0.250 inches, with a radius of 0.062 being particularly preferred. While almost any size or shape actuator would actually compress the foam and close the membrane switch, larger actuators require unreasonably high actuating forces for most product applications and smaller actuators of any shape may pierce or tear the elastomeric layer.

Spring 34 normally maintains key cap 32 spaced from the top of stem 30, the term "normally" being used to refer to the state in which the key is totally unactuated. The spring constant of spring 34 must be carefully selected and matched to the product and application to produce the desired closure characteristics. The length, diameter and wire size or spring 34 are selected to achieve the desired compressibility for the spring. As with elastomer layer 26, the compressibility of spring 34 is expressed in cm/nt (or in in/oz) and is equivalent to the reciprical of the spring constant. Linear springs having compressibility values of from between about 0.12 cm/nt to 1.0 cm/nt (about 0.014 in/oz to about 0.110 in/oz) are suitable for use with the present invention, with preferred values being from about 0.20 cm/nt to about 0.6 cm/nt (about 0.022 in/oz to about 0.066 in/oz).

The keyboard operator will deliver actuating force to key cap 32 to move it in a downward direction. When that actuating force is delivered to the key cap, cap 32 will move downwardly relative to stem 30, with spring 34 thereby being compressed, in the pretravel stage of operation. There will be no initial downward movement of stem 30, and hence no switch actuation, because of the vertical separation between cap 32 and the top of stem 30. After this initial movement of cap 32, cap 32 will contact the top of stem 30 to move stem 30 and actuator 32 downwardly to transfer the actuating force to the elastomer layer. The elastomer layer distributes the actuating force uniformly over essentially the entire cross-sectional area of opening 20 to cause the upper circuit layer to be moved downwardly through opening 20 to bring conductive element 24 into mechanical and electrical contact with conductive element 16 to complete an electrical circuit. The elastomeric layer 26 also serves to decellerate the downward movement of stem 30, and the elastomeric layer 26 continues to be compressed by the downward force on stem 30, to thus contribute a sensation of overtravel.

It will be understood that retainer plate 36 is fixed in position relative to the elastomer membrane structure 10 so that it supports and fixes the mechanical components of key 28 relative to the membrane assembly. A retainer disk 38 between the membrane structure and retainer plate 38 retains the stem against withdrawal from the assembly. The bevelled edge projections from the body of stem 30 permit the stem to be snapped into place by being passed through plate 36 from the bottom; and the upper bevelled element permits cap 32 to be snapped into position on the top of the stem (because the plastic materials accommodate a reasonable amount of compression and/or expansion).

Figure 2:
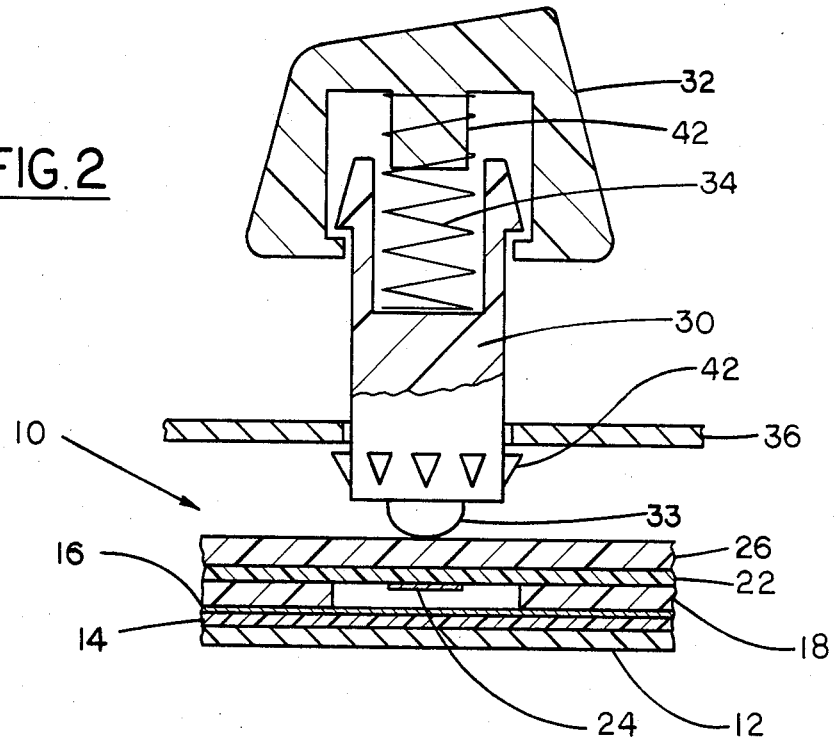
FIG. 2 is a view similar to FIG. 1 showing a second embodiment of a key assembly.

Referring now to FIG. 2, a second embodiment is shown in which all elements are as in the FIG. 1 embodiment with the exception of details of the mechanical key construction. In the FIG. 2 embodiment, key stem 30' is enlarged compared to key stem 30 in FIG. 1; and spring 34' is located in an interior cavity 40 in the stem. Spring 34' extends from the bottom of cavity 40 to a center projection 42 extended downwardly from the top of key 32'. Stem 30' is retained against withdrawal by a plurality of locking projections 42 which extend around the periphery of stem 30 beneath retainer plate 36. As with the configuration of FIG. 1, a snap in method of assembly may be employed, with stem 30' being snapped into place by being passed through plate 36 from the upper side thereof and with key top 32' being snapped into place over the top of stem 30' at the protrusion near the top thereof.

Figure 3:
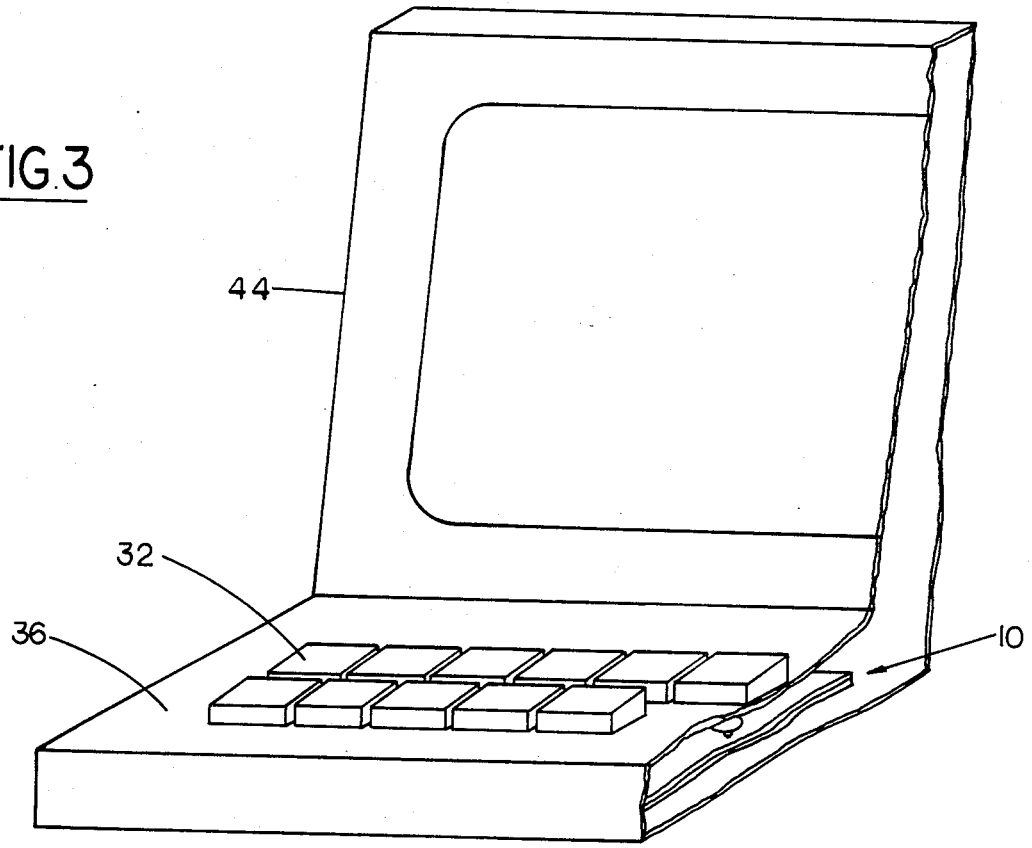
FIG. 3 is a partial sectional view showing a keyboard assembly in accordance with the present invention.

Referring now to FIG. 3, an illustration is shown of a keyboard assembly in accordance with the present invention as it might be used, for example, with a data terminal 44.

As previously indicated, a key switch element in accordance with the present invention may be viewed as being a cooperative arrangement of three spring systems. These three spring systems are comprised of (1) the mechanical spring 34 of key 28 between the key cap 32 and a key stem 30 in each key, (2) the elastomer layer 26 on the membrane array, and (3) each membrane key switch site. The mechanical spring between the key cap and key stem provide for most of the pretravel sensation. The elastomeric layer on the membrane switch array acts as a spring element both to contribute to pretravel and to distribute the closure force from the key stem uniformly over the entire area of the membrane switch (i.e., the area defined at each opening in the spacer or separator layer). The elastomeric layer also decellerates and stops the key travel uniformly by cushioning the impact of the key stem actuator. The elastomeric layer also contributes the sensation of overtravel, and it can also provide for quiet, "click" free operation when the actuator/elastomer interface is properly defined. The membrane key switch itself contributes a spring characteristic in that it moves from the separated and open circuit configuration to a mechanically and electrically closed state in response to the application and imposition of a specifically defined actuating force, thus accomplishing control of the actuating or "fire" point.

In addition to the previously discussed advantages of the present invention, it should also be noted that only a very small actual movement of the stem is required. By way of contrast, in most prior art configurations, displacement of the stem for the full amount of key travel is usually required. Also, only a simple pattern of round holes is required in mounting plate 36, and these holes may be relatively small since they need only to accommodate the stem itself. Many other prior art configurations require much larger holes to accommodate elaborate mounting structure for the stem.

The invention may be viewed in terms of a cooperation arrangement of spring systems having a composite spring characteristic made up of the characteristics of the mechanical spring, elastomer and membrane components. The range of 1/K or compressibility for the composite or equivalent spring in accordance with the present invention is best understood by considering the range of minimum and maximum force desired to actuate keys and the range of maximum and minimum travel desired for a key. The force range is selected from 0.5 oz (0.14 nt) to 4 oz (1.1 nt) and the total key travel (from rest, through pretravel, firing and overtravel) is from 0.150 in. (0.38 cm) to 0.030 in (0.07 cm). Considering the extremes, i.e., minimum force for maximum travel, and maximum force for minimum travel, the range of 1/K for the composite or equivalent spring in accordance with this invention should be from about 0.06 cm/nt (about 0.007 in/oz) (for a keyboard having high force vs. low travel characteristics) to about 2.7 cm/nt (about 0.30 in/oz) (for a keyboard having low force vs. high travel characteristics. This range of 1/K is for the composite or equivalent spring for the entire actuation, including pretravel, firing and overtravel. The actual fire point and the overall human factors variables will depend on the specific selection of parameters and spring characteristics for force vs. displacement for the individual components (mechanical spring, elastomer and membranes) of the composite. This range of composite or equivalent 1/K (about 0.06 cm/nt to about 2.7 cm/nt) is necessary in the present invention to have an effectively operating full travel keyboard. A keyboard having a composite characteristic outside this range will not be an effective full travel keyboard in accordance with the present invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A keyboard including:

membrane switching means, said membrane switching means having:

(a) lower circuit sheet means comprising a first sheet of insulating material with first electrically conductive means thereon;

(b) upper circuit sheet means comprising a second sheet of insulating material with second electrically conductive means on one surface thereof, facing said first circuit means; and (c) spacer means between said first and second circuit sheet means, said spacer means having a plurality of openings therein for mechanical and electrical connection of selective parts of said first and second circuit means defining switch sites;

a layer of compressible elastomeric material on said upper circuit sheet means on the other surface thereof, said elastomeric material constituting a spring system having a predetermined compressibility value; and a plurality of key means for actuating the switch sites, each of said key means including:

(a) switch actuator means in contact with said elastomeric layer at the location of a switch site;

(b) a stem;

(c) a key cap; and (d) spring means normally spacing said cap from said stem, said spring means of said key means having a predetermined compressibility value.

2. The keyboard of claim 1 wherein:

the compressibility of said spring means of said key means is from about 0.12 cm/nt to about 1.0 cm/nt; and the compressibility of said elastomeric material is from about 0.10 cm/nt to about 1.00 cm/nt.

3. The keyboard of claim 1 wherein:

the compressibility of said spring means of said key means is from about 0.20 cm/nt to about 0.60 cm/nt; and the compressibility of said elastomeric material is from about 0.250 cm/nt to about 0.50 cm/nt.

4. The keyboard of any of claims 1, 2 or 3 wherein:

said switch actuator means in contact with said elastomeric material is of hemispherical shape.

5. The keyboard of any of claims 1, 2 or 3 wherein:

said switch actuator means in contact with said elastomeric material is hemispherical in shape and has a radius of from about 0.03 inches to about 0.250 inches.

6. The keyboard of any of claims 1, 2 or 3 wherein:

said switch actuator means in contact with said elastomeric material is hemispherical in shape and has a radius of 0.062 inches.

7. The keyboard of any of claims 1, 2 or 3 wherein:

said spring means, said elastomeric material and said upper circuit sheet means have a composite compressibility from about 0.06 cm/nt to about 2.7 cm/nt.

8. A keyboard including:

a first spring system, said first spring system including:

(a) a key cap;

(b) a key stem;

(c) spring means normally spacing said key cap from said key stem;

a second spring system, said second spring system including:

a layer of compressible elastomeric material, the lower part of said key stem being in contact with one surface of said elastomeric material; and a third spring system, said third spring system including membrane switching means having:

(a) lower circuit sheet means of insulating material with first electrically conductive means thereon;

(b) spacer means on said lower circuit sheet means and having a plurality of openings therein to permit the making of electrical and mechanical contact between switch elements;

(c) upper circuit sheet means of insulating material with second electrically conductive means thereon movable through said openings in said spacer to make switch contact with conductive means on said lower circuit sheet means;

each of said first, second and third spring systems having a predetermined compressibility value, and said layer of compressible elastomeric material being on said upper circuit sheet means.

9. The keyboard of claim 8 wherein:

the compressibility of said first spring system is from about 0.12 cm/nt to about 1.0 cm/nt; and the compressibility of said second spring system is from about 0.10 cm/nt to about 1.00 cm/nt.

10. The keyboard of claim 8 wherein:

the compressibility of said first spring system is from about 0.20 cm/nt to about 0.60 cm/nt; and the compressibility of said second spring system is from about 0.250 cm/nt to about 0.50 cm/nt.

11. The keyboard of any of claims 8, 9 or 10 wherein:

said first spring system, said second spring system and said third spring system have an equivalent compressibility from about 0.06 cm/nt to about 2.7 cm/nt.

12. A keyboard including:

a first spring system, said first spring system including:

(a) a key cap;

(b) a key system;

(c) spring means normally spacing said key cap from said key stem;

a second spring system, said second spring system including:

a layer of compressible elastomeric material, the lower part of said key stem being in contact with one surface of said elastomeric material; and a third spring system, said third spring system including membrane switching means having:

(a) lower circuit sheet means of insulating material with first electrically conductive means thereon;

(b) spacer means on said lower circuit sheet means and having a plurality of openings therein to permit the making of electrical and mechanical contact between switch elements;

(c) upper circuit sheet means of insulating material with second electrically conductive means thereon movable through said openings in said spacer to make switch contact with conductive means on said lower circuit sheet means;

each of said first, second and third spring systems having a predetermined compressibility value, and said layer of compressible elastomeric material being on said upper circuit sheet means;

said first spring system, said second spring system and said third spring system having an equivalent compressibility from about 0.06 cm/nt to about 2.7 cm/nt.

13. The keyboard of claim 12 wherein:

the compressibility of said first spring system is from about 0.12 cm/nt to about 1.0 cm/nt; and the compressibility of said second spring system is from about 0.10 cm/nt to about 1.00 cm/nt.

14. The keyboard of claim 12 wherein:

the compressibility of said first spring system is from about 0.20 cm/nt to about 0.60 cm/nt; and the compressibility of said second spring system is from about 0.250 cm/nt to about 0.50 cm/nt.

15. The keyboard of claim 12 wherein:

said switch actuator means in contact with said elastomeric material is of hemispherical shape.

16. The keyboard of claim 12 wherein:

said switch actuator means in contact with said elastomeric material is hemispherical in shape and has a radius of from about 0.03 inches to about 0.250 inches.

17. The keyboard of claim 12 wherein:

said switch actuator means in contact with said elastomeric material is hemispherical in shape and has a radius of about 0.062 inches.

* * * * *